US008056621B2

(12) United States Patent
Ring et al.

(10) Patent No.: US 8,056,621 B2
(45) Date of Patent: Nov. 15, 2011

(54) MASTER BALL VALVE WITH INTEGRATED HANGER

(75) Inventors: Curtis Phillip Ring, Calgary (CA); Grant George, Calgary (CA); Geoff Steele, Calgary (CA); Jordan James, Edmonton (CA)

(73) Assignee: Stellarton Technologies Inc., Calgary, Alberta (CA)

( * ) Notice: Subject to any disclaimer, the term of this patent is extended or adjusted under 35 U.S.C. 154(b) by 89 days.

(21) Appl. No.: 12/435,920

(22) Filed: May 5, 2009

(65) Prior Publication Data

US 2009/0272522 A1 Nov. 5, 2009

Related U.S. Application Data

(60) Provisional application No. 61/050,490, filed on May 5, 2008.

(51) Int. Cl.
*E21B 19/00* (2006.01)
*E21B 33/04* (2006.01)

(52) U.S. Cl. ..... 166/86.1; 166/88.1; 166/88.2; 166/95.1

(58) Field of Classification Search ..... 166/86.1, 166/88.1, 88.2, 95.1, 75.4; 251/249.5
See application file for complete search history.

(56) References Cited

U.S. PATENT DOCUMENTS 1,587,030 A * 6/1926 Palmer ..... 166/90.1
4,681,133 A * 7/1987 Weston ..... 137/315.18
5,092,400 A * 3/1992 Jagert ..... 166/88.2
5,372,202 A * 12/1994 Dallas ..... 166/386
5,575,336 A * 11/1996 Morgan ..... 166/330
5,865,246 A * 2/1999 Brown ..... 166/95.1
6,192,981 B1 * 2/2001 Boquet et al. ..... 166/75.13
6,729,392 B2 * 5/2004 DeBerry et al. ..... 166/75.14
7,114,573 B2 * 10/2006 Hirth et al. ..... 166/382
7,163,064 B2 * 1/2007 Moncus et al. ..... 166/379
7,275,591 B2 * 10/2007 Allen et al. ..... 166/86.1
7,615,893 B2 * 11/2009 Biester et al. ..... 307/82
2009/0294136 A1 * 12/2009 Jones et al. ..... 166/386

OTHER PUBLICATIONS

Wellhead Inc., manufacturer of wellhead equipment; Independent Casinghead specification sheet.
Cooper, casing specifications.
DynaSeal 310 Ball Valve 2-Piece Design specification sheet.
DynaSeal 310 Ball Valve 3-Piece Design specification sheet.
Demco—DM Gate Valve specification sheet.
Walker Steel, a division of Emco Limited—API 6A & 14D "D-Seal" Dual Seal Gate Valves specification sheet.
Walker Steel, a division of Emco Limited—Casing Heads specification sheet.
Cooper Industries—Pow-R-Seal M-3 Gate Valve, 20,000 psi WP specification sheet.
Walker Steel, a divsiion of Emco Limited, p. 24—Walker expanding gate value specification sheet.
Triad Process Equipment—series 9000 split body flange ball value: 9150 ANSI class 150, 93000 ANSI class 300 specification sheet.
Triad Process Equipment—series 9150D 3" through 6" specification sheet.

(Continued)

*Primary Examiner* — William P Neuder
*Assistant Examiner* — Sonya Bible
(74) *Attorney, Agent, or Firm* — Bennett Jones LLP

(57) ABSTRACT

A master ball valve with an integrated main hanger below the valve which may be used to hang jointed tubing, coil tubing, or electrified coil tubing for connection with an electric submersible pump.

3 Claims, 4 Drawing Sheets

OTHER PUBLICATIONS

Triad Process Equipment—Series 9150 D direct mount 150# Flanged ball valve with Radius Series A rack and pinion actuators sizing guide.

Clow Valve Company—2" -12" L14 mechanical joint double disc gate valve specification sheet and operation and maintenance sheet—Dec. 8, 2005.

Walker Steel, a division of Emco Limited p. 10 and 16—GA-1 Tubing Hanger, WP-1 Tubing Hanger, XP-1 Tubing Hanger, WH-1 Tubing Hanger, GO-2 Tubing Head Adapter, Type H Back Presure Valves and Plugs.

Walker Steel, a divsiion of Emco Limited p. 16—G02 Tubing Head Adapter.

* cited by examiner

MASTER BALL VALVE WITH INTEGRATED HANGER

CROSS REFERENCE TO RELATED APPLICATIONS

This application claims the priority benefit of U.S. Provisional Patent Application No. 61/050,490 filed on May 5, 2008 entitled "Master Ball Valve with Integrated Hanger", the contents of which are incorporated herein by reference.

FIELD OF THE INVENTION

The present invention relates to a wellhead system for use in oil and gas production.

BACKGROUND

A producing well will have a wellhead or Christmas tree at the surface for controlling the well. The wellhead assembly supports casing which extends into the well. Tubing extends through the casing for producing the formation fluids. The Christmas tree is a tubular body having a bore extending vertically through it with outlets leading from the bore through the sidewall. Valves are mounted in the bore and to the outlets of the tree for providing access to the tubing as well as directing the produced fluid out to a flow line.

Current wellhead technology on shallow gas wells utilizes Demco style gate valves which were originally designed for use on mud lines on the surface of a drilling rig. They are not readily field serviceable, primarily because they were not intended for use in a wellhead.

Current wellhead technology for shallow gas wells does not provide the capability of hanging a coil tubing string below an existing wellhead. The existing wellhead is decommissioned in place, and the secondary string or coil tubing string is suspended from above the existing master valve. Accordingly, secondary well control is needed as well as a new wellhead above the current master valve.

There is a need in the art for a wellhead valve that mitigates the difficulties of the prior art.

SUMMARY OF THE INVENTION

The present invention comprises a master ball valve with an integrated main hanger below the valve. The ball valve may be gear actuated. The main hanger may be used to hang jointed tubing, coil tubing, or electrified coil tubing for connection with an electric submersible pump. A hanger plug may isolate the master valve from well pressure to permit servicing of the valve.

The valve may be installed on a new or existing well to facilitate hanging a jointed tubing string, coil tubing string or running a casing lift system.

Therefore, in one aspect, the invention may comprise a wellhead master valve and integrated hanger apparatus comprising:

(a) a housing defining an inner throughbore having a hanger profile;

(b) a valve ball disposed within the inner bore above the hanger profile;

(c) a wormgear assembly comprising a wormshaft and a gear operatively connected to the valve ball, wherein rotation of the worm shaft causes rotation of the valve ball;

(d) a hanger comprising a locking dog which mates to the hanger profile, a moveable cone for actuating the locking dog, and defining a throughbore having an inner profile for suspending tubing within the wellbore.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The present invention relates to a wellhead valve assembly including a main hanger. Any term or expression not expressly defined herein shall have its commonly accepted definition understood by those skilled in the art.

In one embodiment, the present invention comprises a low pressure ball valve and an integrated hanger.

Figure 1:
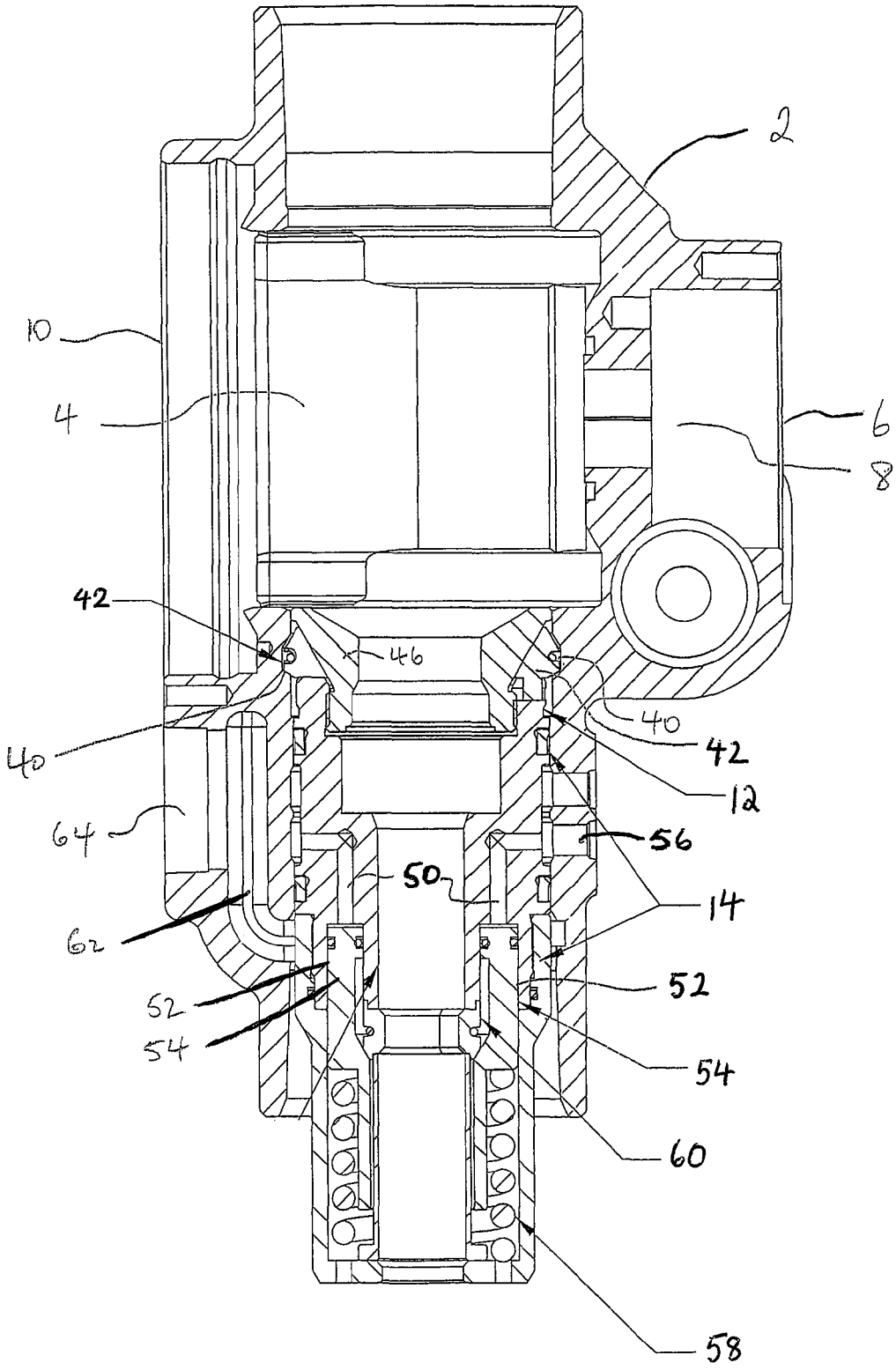
FIG. 1 is a cross-section view of the master ball valve and an integrated hanger.

One embodiment of the valve is shown in cross-section in FIG. 1. The valve housing (2) encloses a rotating ball (4) having an opening of sufficient size to allow downhole tools and tubing to pass through the valve when it is open. On one side, a removable gear cap (6) allows access to service the gear assembly (8) which turns the ball (4), thereby opening and closing the valve. On the opposite side, a service access panel (10) is removeable to allow removal and replacement of the valve internals.

A hanger body (12) is disposed below the valve ball (4) and is well sealed to the throughbore of the valve housing (2) with hanger seals (14).

Figure 2B:
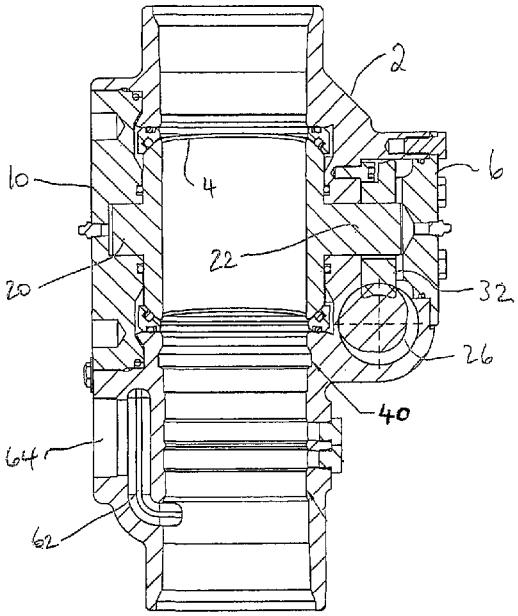
FIG. 2B shows a cross-section along line IIB in FIG. 2A.
Figure 2A:
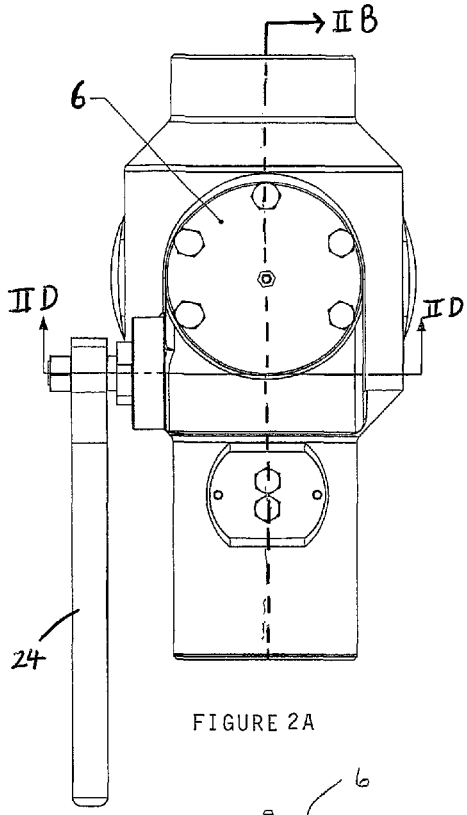
FIG. 2A shows a side view of one embodiment of the invention.
Figure 2C:
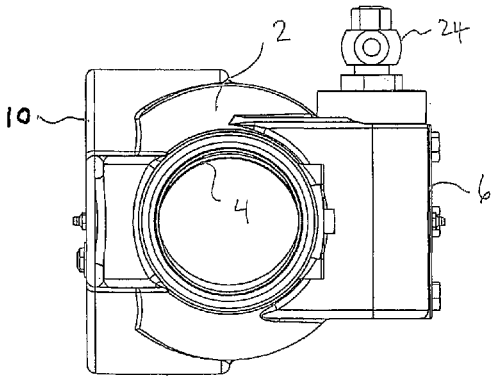
FIG. 2C shows a cross-section along line IIC in FIG. 2A.
Figure 2D:
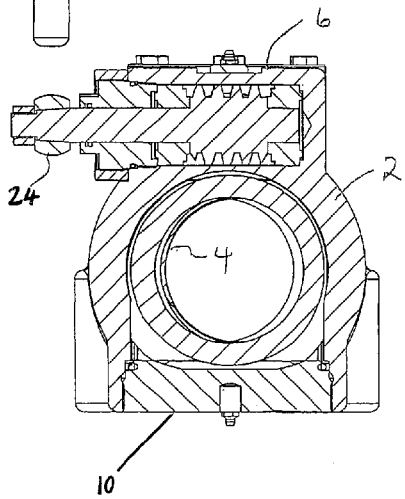
FIG. 2D shows a bottom view of the embodiment of FIG. 2A.

As shown in FIG. 2A, the valve ball (4) sits within the housing (2) supported by shafts (20, 22) disposed on either side of the ball (4). The ball valve is actuated manually with a rotatable handle (24), connected to a wormshaft (26) shown in FIG. 2B. The wormshaft (26) is supported within the gear housing (28) by roller bearings (30) and advances the gear ring (32) which is keyed to the ball shaft (22). Accordingly, rotation of the handle (24) rotates the ball (4) about its axis, defined the axes of the shafts (20, 22).

Figure 3:
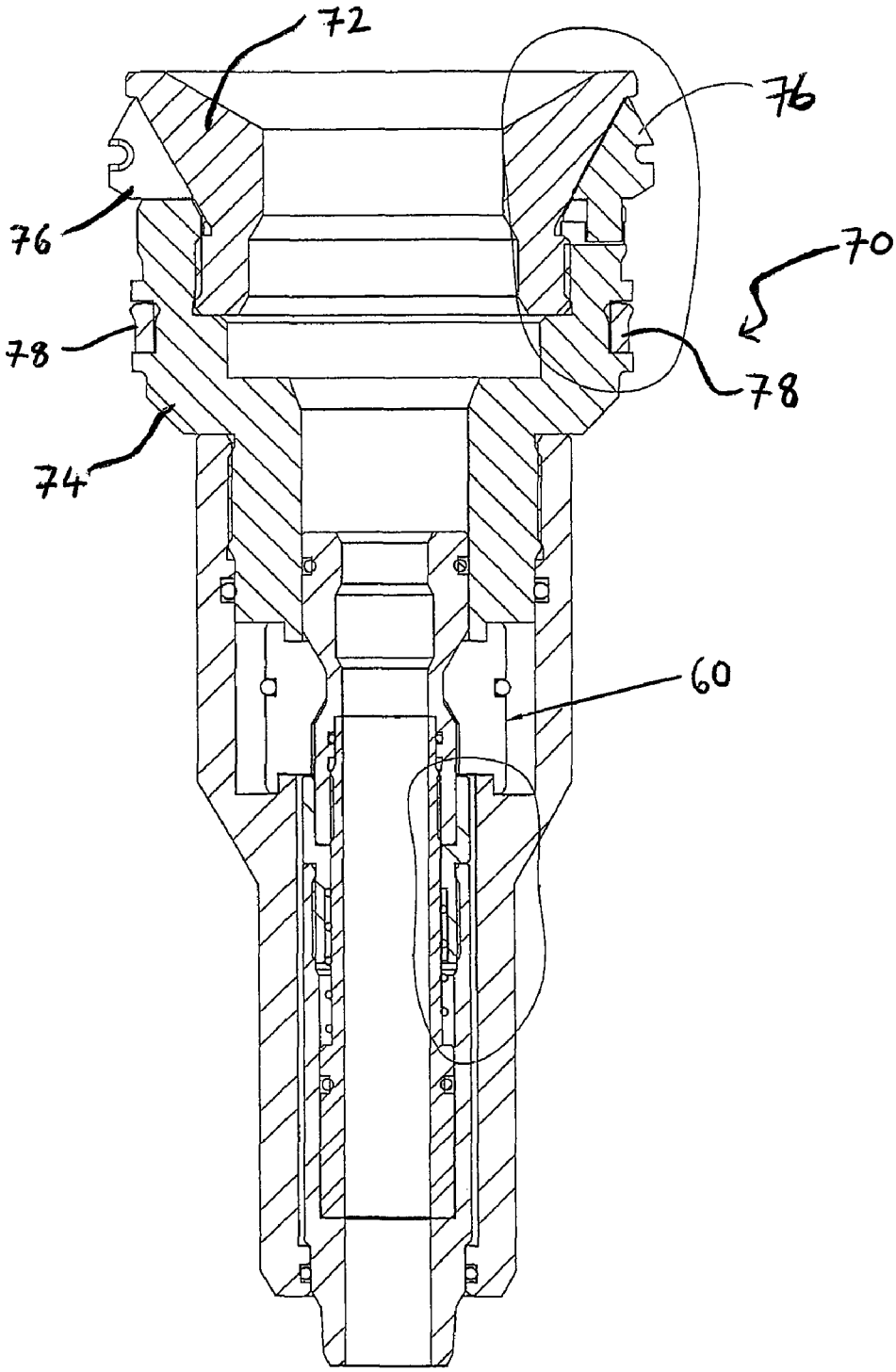
FIG. 3 shows a cross-sectional view of a coil tubing hanger.
Figure 4:
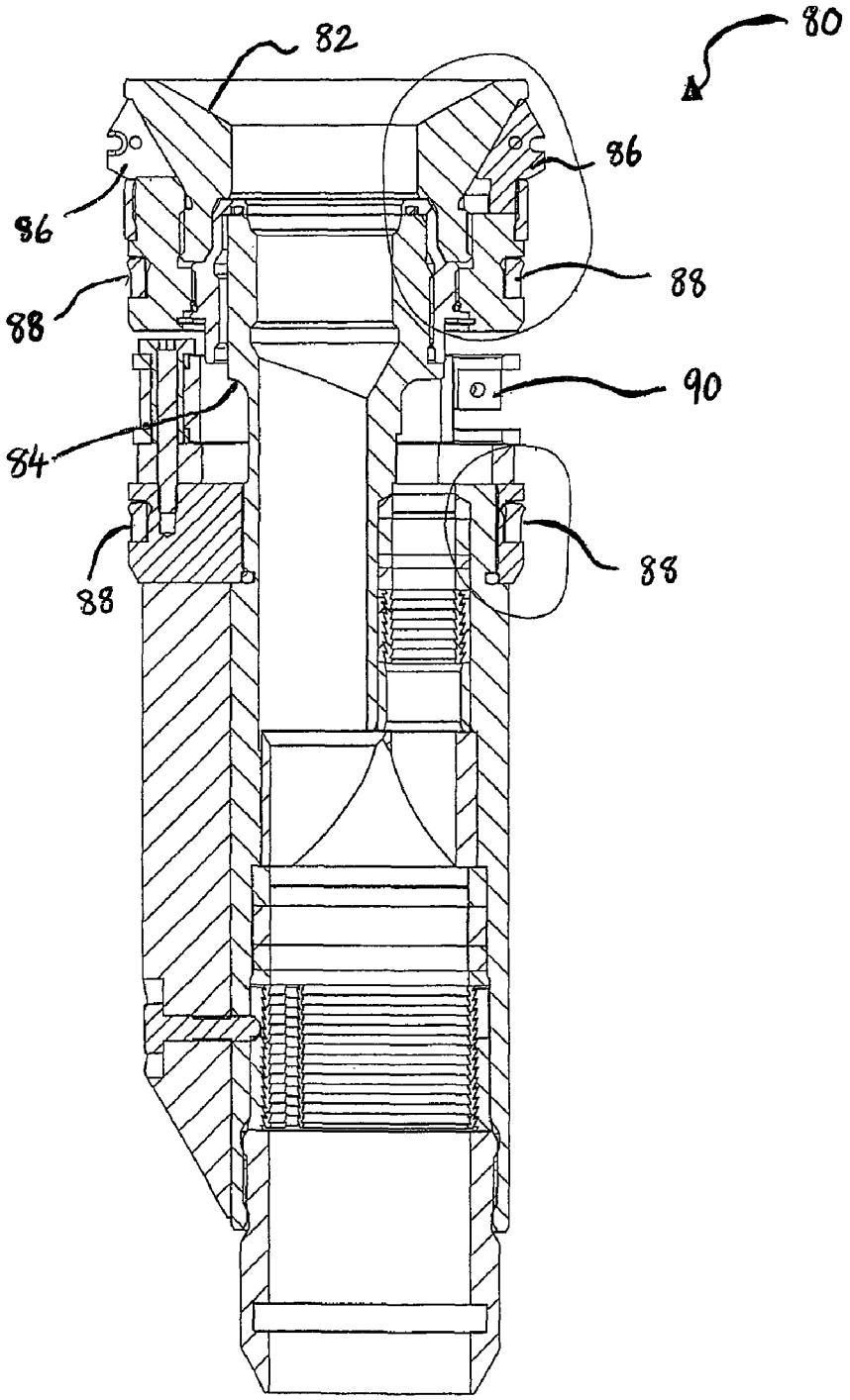
FIG. 4 shows a cross-sectional view of a hanger for electrified coil tubing and an electric submersible pump assembly.

Immediately below the ball valve, the throughbore of the housing (2) defines an inner profile (40) which mates with locking dogs (42) on a hanger body (12). The hanger may be any suitable hanger design, including hydraulic or mechanical hangers. Exemplary embodiments of different hangers are shown in FIGS. 1, 3 and 4. The hanger may comprise a hanger plug (not shown) which isolates the ball valve from well pressure, and therefore allows valve servicing without killing the well, or without installing a wireline retrievable bridge plug.

The hanger cone (46) threads into the hanger body (12) and as it does, it expands the locking dogs (42) outwards to mate with the housing (2) inner profile (40). As the cone (46) is removed from the hanger body (44), the locking dogs collapse inward, permitting removal of the hanger from the housing (2).

In one embodiment shown in FIG. 1, the hanger is a hydraulically actuated hanger having channels (50) which lead to a hydraulic chamber (52). An actuating piston (54) resides in the chamber and is responsive to hydraulic pressure. Hydraulic pressure may be applied to the actuating piston (54) through hydraulic ports (56) in the valve housing (2) below the ball valve. A locking coil spring (58) resists the downward motion of the actuating piston (54), and biases the locking dogs (60) into their locked position.

Therefore, as may be seen in FIG. 1, when hydraulic pressure is applied through the ports (56), the actuating piston (54) is forced downward in chamber (52) and spring (58) is compressed. The actuating piston (54) defines an inner cone which engages the locking dogs (60). As the actuating piston (54) is forced downwards, the cone disengages the locking dogs (60) which releases the profile (not shown) of the assembly supported within the hanger.

The lower portion of the housing (2) may define a cavity (62) which leads to the exterior of the hanger body (12). This cavity (62) may provide fluid communication with the annular space between the casing and the tubing. A annular port (64), such as a 2" NPT for example, may provide access to the annular cavity (62).

In one embodiment, the hanger may comprise a coil tubing hanger. One example is shown in FIG. 3. The coil tubing hanger (70) has an upper portion comprising a locking and sealing configuration similar to the hanger shown in FIG. 1. A cone (72) threads onto the hanger body (74) which actuates locking dogs (76) which engage the valve housing (2) as described above. A hanger seal (78) seals against the throughbore of the valve housing (2). The lower portion may be adapted to suspend coil tubing in a releasable manner, one exemplary configuration of which is shown in FIG. 3.

An alternative hanger (80) may be used to suspend a coil tubing string with an electric submersible pump may be run into the well, through the ball valve and main hanger profile. The electrified coil tubing hanger (80) has an upper portion comprising a locking and sealing configuration similar to the hanger shown in FIG. 1. A cone (82) threads onto the hanger body (84) which actuates locking dogs (86) which engage the valve housing (2) as described above. Hanger seals (88) seals against the throughbore of the valve housing (2). The lower portion may be adapted to suspend electrified coil tubing in a releasable manner, one exemplary configuration of which is shown in FIG. 4.

The hanger (80) shown in FIG. 4 is specifically adapted to facilitate and support a coil tubing string and an electric submersible pump, such as that described in co-owned and co-pending U.S. patent application Ser. No. 12/325,677 entitled "Bottom Hole Hollow Core Electric Submersible Pumping System", filed on Nov. 30, 2008, the contents of which are incorporated by reference.

An electric connection may be made through the main hanger body, and into the tubing hanger, which permits an electrical connection made to an electric conducter running downhole within the tubing, or formed as part of the tubing, such as described in co-owned and co-pending U.S. patent application Ser. No. 12/325,766 entitled "Electrified Coiled Tubing", and filed on Nov. 30, 2008, the contents of which are incorporated by reference. Conveniently, the port which may be used as a hydraulic port (56) in FIG. 1 may be used to run in an electrical connector which connects to electric terminal (90).

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

The invention claimed is:

1. A wellhead master valve and integrated hanger apparatus comprising:

(a) a housing defining an inner throughbore having a hanger profile;

(b) a valve ball disposed within the inner bore above the hanger profile;

(c) a wormgear assembly comprising a wormshaft and a gear operatively connected to the valve ball, wherein rotation of the worm shaft causes rotation of the valve ball;

(d) a hanger comprising a locking dog which mates to the hanger profile, a moveable cone for actuating the locking dog, and defining a throughbore having an inner profile for suspending tubing within a wellbore.

2. The apparatus of claim 1 wherein the housing defines a hydraulic port, and the hanger comprises:

(a) a hydraulically actuated piston having an inner cone; and (b) a second locking dog disposed within the hanger;

wherein vertical displacement of the piston by hydraulic pressure introduced to the hydraulic port causes disengagement of the second locking dog.

3. A wellhead master valve and integrated hanger apparatus comprising:

(a) a housing defining an inner throughbore having a hanger profile;

(b) a valve ball disposed within the inner bore above the hanger profile, the valve ball having an opening of sufficient size to permit the passage of production tubing and tools through the valve ball opening;

(c) a wormgear assembly comprising a wormshaft and a gear operatively connected to the valve ball, wherein rotation of the worm shaft causes rotation of the valve ball; and (d) a hanger comprising a locking dog which mates to the hanger profile, a moveable threaded cone that threads onto the housing for actuating the locking dog, and defining a throughbore having an inner profile for suspending tubing within a wellbore.

* * * * *